United States Patent [19]

Olson et al.

[11] Patent Number: 4,910,092

[45] Date of Patent: Mar. 20, 1990

[54] YTTRIUM ENRICHED ALUMINIDE COATING FOR SUPERALLOYS

[75] Inventors: Walter E. Olson; Dinesh K. Gupta, both of Vernon, Conn.

[73] Assignee: United Technologies Corporation, Hartford, Conn.

[21] Appl. No.: 131,481

[22] Filed: Dec. 3, 1987

Related U.S. Application Data

[63] Continuation-in-part of Ser. No. 903,831, Sep. 3, 1986.

[51] Int. Cl.[4] ..... B22F 7/04

[52] U.S. Cl. ..... 428/557; 428/565; 428/678; 428/680

[58] Field of Search ..... 428/680, 656, 678, 557

[56] References Cited

U.S. PATENT DOCUMENTS

| | | | |
|---|---|---|---|
| Re. 30,995 | 7/1982 | Rairden, III | 428/680 |
| Re. 31,339 | 8/1983 | Dardi et al. | 428/678 |
| Re. 32,121 | 4/1986 | Gupta et al. | 428/656 |
| 3,129,069 | 4/1964 | Hanink et al. | 428/937 |
| 3,594,219 | 7/1971 | Maxwell et al. | 117/131 |
| 3,869,779 | 3/1975 | Gedwill et al. | 29/194 |
| 3,873,347 | 3/1975 | Walker et al. | 117/71 |
| 3,874,901 | 4/1975 | Rairden, III | 117/71 |
| 3,918,139 | 11/1975 | Felten | 29/194 |
| 3,961,098 | 6/1976 | Bessen | 427/34 |
| 3,979,273 | 9/1976 | Panzera et al. | 204/192 |
| 3,999,956 | 12/1976 | Stueber et al. | 29/194 |
| 4,005,989 | 2/1977 | Preston | 428/678 |
| 4,024,294 | 5/1977 | Rairden, III | 427/42 |
| 4,080,486 | 3/1978 | Walker et al. | 428/653 |
| 4,101,713 | 7/1978 | Hirsch et al. | 428/554 |
| 4,117,179 | 9/1978 | Jackson et al. | 427/405 |
| 4,123,594 | 10/1978 | Chang | 428/651 |
| 4,123,595 | 10/1978 | Chang | 428/667 |
| 4,152,223 | 5/1979 | Wallace et al. | 204/37 |
| 4,198,442 | 4/1980 | Gupta et al. | 427/34 |
| 4,246,323 | 1/1981 | Bornstein et al. | 428/678 |
| 4,371,570 | 2/1983 | Goebel et al. | 427/248.1 |
| 4,382,976 | 5/1983 | Restall | 427/34 |
| 4,419,416 | 12/1983 | Gupta et al. | 428/678 |
| 4,585,481 | 4/1986 | Gupta et al. | 428/656 |
| 4,615,865 | 10/1986 | Duvall et al. | 420/588 |
| 4,801,513 | 1/1989 | Duhl et al. | 428/678 |

*Primary Examiner*—Stephen J. Lechert, Jr.
*Attorney, Agent, or Firm*—James M. Rashid

[57] ABSTRACT

A protective coating system for superalloys is described. The coating is an yttrium enriched aluminide, and can be formed by aluminizing an MCrAlY coated superalloy, wherein during the aluminizing process, aluminum diffuses completely through the MCrAlY coating and into the substrate. The coating system exhibits desirable oxidation resistance and resistance to thermal fatigue cracking.

4 Claims, 3 Drawing Sheets

YTTRIUM ENRICHED ALUMINIDE COATING FOR SUPERALLOYS

This application is a continuation-in-part of application Ser. No. 903,831, which is a continuation-in-part of application Ser. No. 787,570, filed Oct. 15, 1985, now abandoned.

TECHNICAL FIELD

The present invention relates to protective coatings for metal substrates. More particularly, the present invention relates to yttrium enriched aluminide coatings for gas turbine engine components.

BACKGROUND ART

The superalloys are a class of materials which exhibit desirable mechanical properties at high temperatures. These alloys generally contain major amounts of nickel, cobalt and/or iron either alone or in combination, as their basis material, and alloying additions of elements such as chromium, aluminum, titanium, and the refractory metals. Superalloys have found numerous applications in gas turbine engines.

In most gas turbine applications, it is important to protect the surface of the engine component from oxidation and corrosion degradation, as such attack may materially shorten the useful life of the component, and cause significant performance add safety problems.

Coatings can be used to protect superalloy engine components from oxidation and corrosion. The well known family of coatings commonly referred to as MCrAlY coatings, where M is selected from the group consisting of iron, nickel, cobalt, and various mixtures thereof, can markedly extend the service life of gas turbine engine blades, vanes, and like components. MCrAlY coatings are termed overlay coatings, denoting the fact that they are deposited onto the superalloy surface as an alloy, and do not interact significantly with the substrate during the deposition process or during service use. As is well known in the art, MCrAlY coatings can be applied by various techniques such as physical vapor deposition, sputtering, or plasma spraying. MCrAlY coatings may also include additions of noble metals, hafnium, or silicon, either alone or in combination. They may also include other rare earth elements in combination with or substitution for yttrium. See, e.g., the following U.S. patents which are incorporated by reference: U.S. Pat. Nos. 3,542,530, 3,918,139, 3,928,026, 3,993,454, 4,034,142, and Re. 32,121.

U.S. Pat. No. Re. 32,121 states that MCrAlY coatings are the most effective coatings for protecting superalloys from oxidation and corrosion attack.

Aluminide coatings are also well known in the art as capable of providing oxidation and corrosion protection to superalloys. See, for example, U.S. Pat. Nos. 3,544,348, 3,961,098, 4,000,507 and 4,132,816, which are incorporated by reference.

During the aluminizing process there is significant interaction between the aluminum and the substrate; the substrate chemistry and deposition temperature exert a major influence on coating chemistry, thickness and properties. A disadvantage of aluminide coatings is that in the thicknesses required for optimum oxidation and corrosion resistance, generally taught by the prior art to be about 0.0035 inches, the coatings are brittle and can crack when subjected to the stresses which gas turbine engine blades and vanes typically experience during service operation. These cracks may propagate into the substrate and limit the structural life of the superalloy component; the tendency to crack also results in poor oxidation and corrosion resistance, as discussed in U.S. Pat. Nos. 3,928,026, 4,246,323, 4,382,976, and Re. 31,339.

Aluminide coatings less than about 0.0035 inches thick may have improved crack resistance, but the oxidation resistance of such thin aluminides is not as good as that of the MCrAlY coatings.

In U.S. Pat. Nos. 3,873,347 and 4,080,486, an attempt is made to combine the advantages of MCrAlY coatings and aluminide coatings. Therein, an MCrAlY coating, preferably 0.003–0.005 inches thick, is aluminized in a pack cementation process, wherein radially aligned defects in the MCrAlY coating are infiltrated with aluminum diffusing inwardly from the pack mixture. More importantly, a high concentration of aluminum results at the outer surface of the MCrAlY coating, which improves the high temperature oxidation resistance of the coating as compared to the untreated MCrAYY. Both patents state that in laboratory tests, the aluminized MCrAlY coating exhibited improved corrosion resistance, although this is somewhat at variance with the conventional wisdom that aluminum enrichment improve oxidation resistance rather than corrosion resistance.

According to U.S. Pat. No. Re. 30,995, in order to prevent cracking and spalling of an aluminized MCrAlY coating from the substrate, the aluminum must not diffuse into the substrate; aluminum may diffuse no closer than 0.0005 inches to the MCrAlY/substrate interface. It is also stated that the aluminum content in the aluminized MCrAlY must be less than ten weight percent, in order to achieve the best combination of coating properties.

In U.S. Pat. No. 3,961,098, an MCr powder is flame sprayed onto a metallic substrate in such a manner that the powder particles are substantially non-molten when they strike the substrate surface. Aluminum is subsequently diffused through the overlay coating, and into the substrate surface. Laboratory tests revealed that the aluminizing step must be conducted so that the final aluminum concentration in the coating is less than 20 weight percent, or else the coating will be brittle, and will have unacceptable corrosion and oxidation resistance.

U.S. Pat. No. 4,246,323 teaches a process for enriching an MCrAlY coating with aluminum. The processing is conducted so that Al diffuses only into the outer surface of the MCrAlY. The outer, Al rich portion of the coating is reported to be resistant to oxidation degradation, and the inner, unaluminized MCrAlY reportedly has good mechanical properties.

In U.S. Pat. No. Re. 31,339 an MCrAlY coated superalloy component is aluminized, and then the coated component is hot isostatically pressed. A substantial increase in coating life is reported, which is attributed to the presence of a large reservoir of an aluminum rich phase in the outer portion of the MCrAlY. As in the patents discussed above, the aluminum diffuses only into the MCrAlY outer surface. U.S. Pat. No. 4,152,223 discloses a process similar to that of U.S. Pat. No. Re. 31,339, in which an MCrAlY coated superalloy is surrounded by a metallic envelope, and then hot isostatically pressed to close any defects in the MCrAlY coating and to diffuse a portion of the envelope into the overlay. If aluminum foil is used as the envelope, the foil may melt during hot isostatic pressing and form intermetallic compounds with the substrate. It is stated that these compounds may enhance the oxidation resistance of the coating. However, such intermetallics may have an undesired effect on the fatigue strength of the coated component.

In U.S. Pat. No. 4,382,976, an MCrAlY coated superalloy component is aluminized in a pack process wherein the pressure of the inert carrier gas is cyclicly varied. Aluminum infiltrates radially aligned defects of the overlay, and reacts with the MCrAlY to for various intermetallic, aluminum containing phases. The extent of Al diffusion into the substrate alloy was reported to be significantly less than if the aluminizing were carried out directly on the substrate.

In U.S. Pat. No. 4,101,713, high energy milled MCrAlY powders are applied to superalloy substrates by flame spray techniques. It is stated that the coated component can be aluminized, whereby aluminum would diffuse into the MCrAlY coating, and if desired, into the substrate material. However, according to U.S. Pat. No. Re. 30,995 (issued to the same inventor) diffusion of aluminum into the substrate may cause spalling of the MCrAlY coating from the substrate.

Other U.S. patents which disclose aluminized MCrAlY coatings are U.S. Pat. Nos. 3,874,901 and 4,123,595.

In U.S. Pat. No. 4,005,989, a superalloy component is first aluminized and then an MCrAlY overlay is deposited over the aluminized layer. The two layer coating is heat treated at elevated temperatures, but no information is given as to the results of such heat treatment. The coating was reported to have improved resistance to oxidation degradation compared to the aluminized MCrAlY coatings discussed above.

Other patents which indicate the general state of the art relative to coatings for superalloys include U.S. Pat. Nos. 3,676,085, 3,928,026, 3,979,273, 3,999,956, 4,109,061, 4,123,594, 4,132,816, 4,198,442, 4,248,940, and 4,371,570.

As the operating conditions for superalloy components become more severe, further improvements are required in oxidation and corrosion resistance, and resistance to thermal mechanical fatigue. As a result, engineers are continually seeking improved coating systems for superalloys. The aforementioned advances in coating technology have markedly improved resistance to oxidation degradation. However, these advances have failed to address what is now viewed as the life limiting property for coated superalloys: resistance to thermal mechanical fatigue cracking.

DISCLOSURE OF THE INVENTION

It is an object of the present invention to provide an improved coating system for superalloys.

Yet another object of the present invention is a low cost coating system for superalloys.

Another object of the present invention is a coating system for superalloys which has improved resistance to oxidation degradation, and improved resistance to thermal mechanical fatigue.

Yet another object of the present invention is a coating system for superalloy which has the oxidation resistance of MCrAlY coatings, and the resistance to thermal mechanical fatigue cracking of thin aluminide coatings.

According to the present invention, a coated gas turbine engine component comprises a superalloy substrate having a thin yttrium enriched aluminide coating thereon. The coating has the oxidation resistance of currently used MCrAlY coatings, and thermal fatigue life which is significantly better than current MCrAlY coatings and equal to that of the best aluminide coatings.

The coating of the present invention may be produced by applying a thin, nominally 0.0015 inch, MCrAlY overlay coating to the surface of the superalloy substrate, and then subjecting the coated component to a pack aluminizing process wherein aluminum from the pack diffuses into and through the MCrAlY coating and into the superalloy substrate. The MCrAlY coating preferably consists essentially of, by weight percent, 20–38 Co, 12–20 Cr, 10–14 Al, 2–3.5 Y, balance Ni. More preferably, it consists essentially of 30–38 Co, 12–20 Cr, 10–14 Al, 2–3.5 Y, balance Ni. Most preferably, it consists essentially of about 35 Co, 15 Cr, 11 Al, 2.5 Y, balance Ni. The resultant invention coating has a duplex microstructure and is about 0.001 to 0.004 inches thick; the outer zone of the duplex microstructure ranges from between about 0.0005 to about 0.003 inches, and comprises, inter alia, about 20–35 weight percent Al enriched with about 0.2–2.0 weight percent Y. The high Al content in the outer zone provides optimum oxidation resistance, and the presence of Y results in improved alumina scale adherence which reduces the rate of Al depletion from the coating during service operation.

As a result, the coating has better oxidation resistance than current aluminide coatings, and comparable or better oxidation resistance than current MCrAlY coatings. The inner, or diffusion coating zone contains a lesser concentration of aluminum than the outer zone, but a greater concentration of Al than the substrate. The diffusion zone act to reduce the rate of crack propagation through the coating and into the substrate. As a result, specimens coated according to the present invention have improved resistance to thermal mechanical fatigue cracking relative to overlay coated specimens, and comparable resistance to thermal mechanical fatigue cracking relative to specimens coated with the most crack resistant aluminides.

The primary advantage of the coating of the present invention is that it combines the desired properties of aluminide coatings and overlay coatings to a degree never before achieved.

Another advantage of the coating of the present invention is that it is easily applied using techniques well known in the art.

The foregoing and other objects, features and advantages of the present invention will become more apparent in the light of the following detailed description of the preferred embodiments thereof as illustrated in the accompanying drawing.

BEST MODE FOR CARRYING OUT THE INVENTION

The present invention is a diffused, yttrium enriched aluminide coating for superalloys. In one embodiment described below, the coating may be produced by first applying a thin MCrAlY overlay to the surface of the superalloy, and then aluminizing the MCrAlY coated component. The resultant coating microstructure is similar to the microstructure of aluminide coatings, but contains yttrium in sufficient concentrations to markedly improve the coating oxidation resistance. Unlike simple MCrAlY overlay coatings, the coating of the present invention includes a diffusion zone which is produced during the aluminizing step, which, as will be described below, results in the coated component having desirable thermal mechanical fatigue strength.

The coating has particular utility in protecting superalloy gas turbine engine components from oxidation and corrosion degradation, and has desirable resistance to thermal fatigue. Blades and vanes in the turbine section of such engines are exposed to the most severe operating conditions, and as a result, the coating of the present invention will be most useful in such applications.

Figure 1:
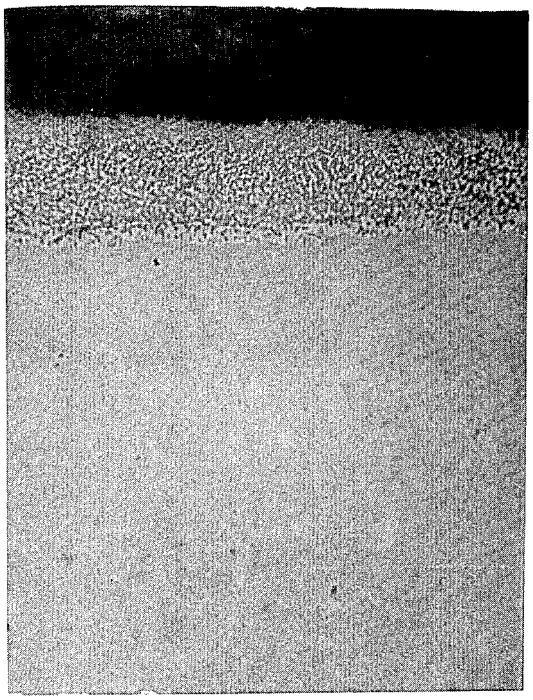
FIG. 1 is a photomicrograph (750×) of an MCrAlY overlay coating useful in producing a coating according to the present invention.
Figure 2:
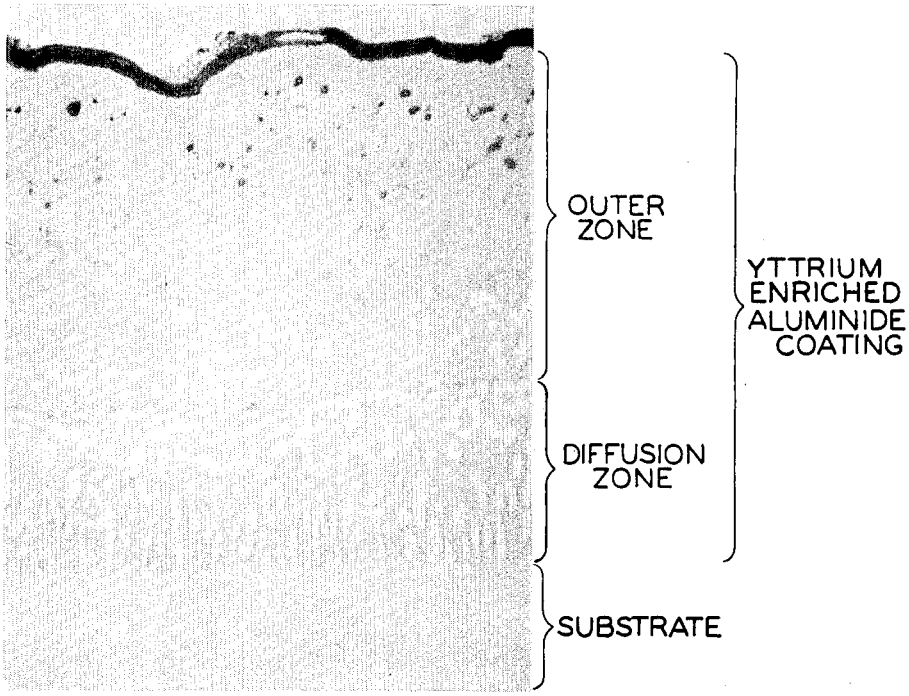
FIG. 2 is a photomicrograph (750×) of the coating according to the present invention.

The coating of the present invention is best described with reference to FIGS. 1 and 2. FIG. 1 is a photomicrograph of an MCrAlY overlay coating, approximately 0.001 inches thick, applied to the surface of a nickel base superalloy. As is typical of overlay coatings, the MCrAlY forms a discrete layer on the superalloy surface; there is no observable diffusion zone between the MCrAlY and the substrate. FIG. 2 is a photomicrograph showing the microstructure of the coating of the present invention, etched with a solution of 50 milliliters (ml) lactic acid, 35 ml nitric acid, and 2 ml hydrofluoric acid. The coating shown in FIG. 2 was produced by aluminizing a thin MCrAlY overlay coating similar to the coating of FIG. 1. Metallographically, it is seen that the coating of the present invention has a duplex microstructure, characterized by an outer zone and inner, diffusion zone between the outer zone and substrate. Electron microprobe microanalysis has indicated that on a typical nickel base superalloy, the outer zone nominally contains, on a weight percent basis, about 20–35 Al about 0.2–2.0 Y, up to about 40 Co, and about 5–30 Cr, with the balance nickel. As will be described in further detail below, the final outer zone composition results from the addition of about 10–25% Al to the preexisting MCrAlY coating composition during the aluminizing process. The diffusion zone contains a lesser concentration of Al than the outer zone, and a greater concentration of Al than the substrate; it also contains elements of the substrate. The diffusion zone also may include (Ni,Co)Al intermetallic compounds, a nickel solid solution, and various Y containing compounds.

While the coating of the present invention may be produced by an overlay coating process followed by a diffusion process, the resultant coating microstructure is metallographically similar to that of many aluminide coatings. Since the coating also includes a significant amount of Y, the coating of the present invention is referred to as an yttrium enriched aluminide.

Figure 3:
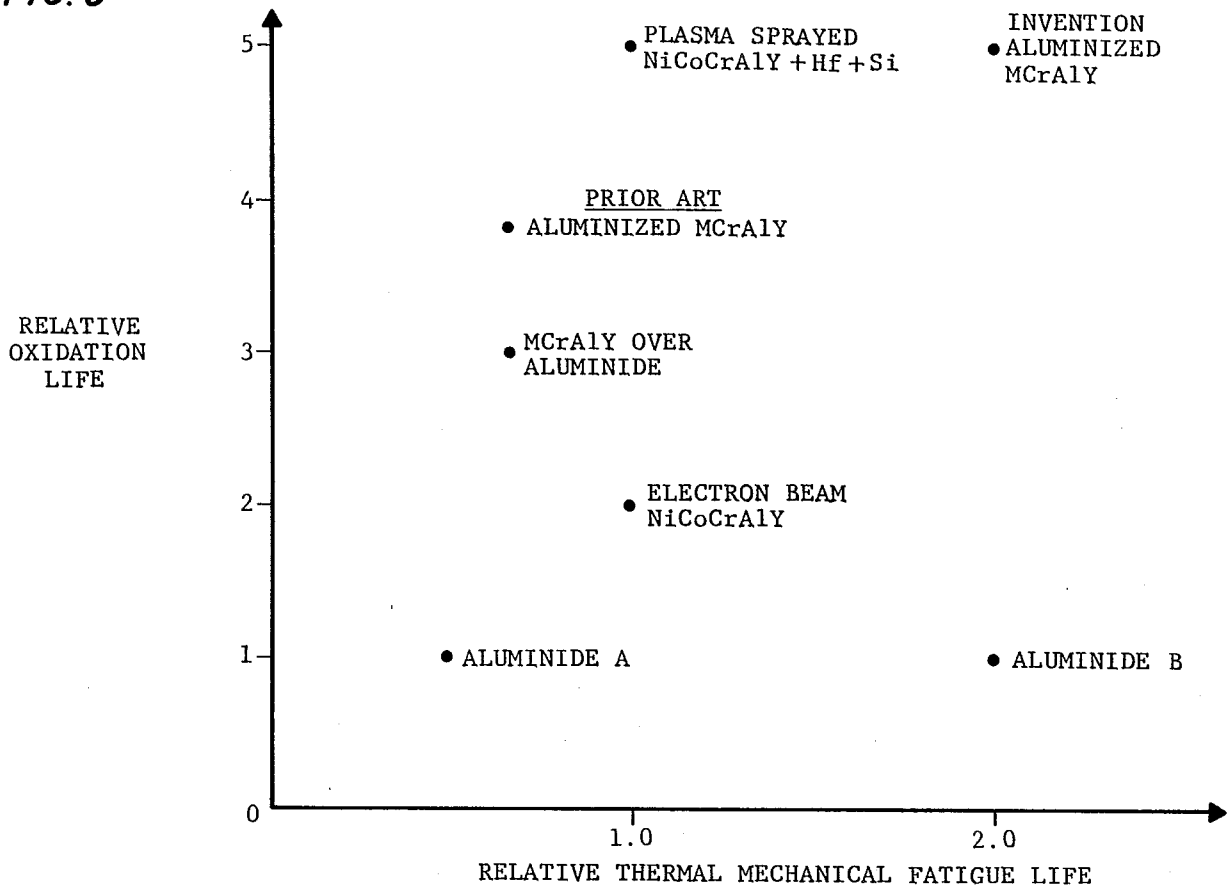
FIG. 3 shows comparative oxidation and thermal mechanical fatigue behavior of several coatings, including the coating of the present invention.

FIG. 3 presents the Relative Oxidation Life as a function of Relative Thermal Mechanical Fatigue Life for seven coatings applied to a commercially used Ni base superalloy. Relative Oxidation Life is a measure of the time to cause a predetermined amount of oxidation degradation of the substrate; in tests to determine the oxidation life of the coatings, laboratory specimens were cycled between exposures at 2,100° F. for 55 minutes and 400° F. for 5 minutes. Relative Thermal Mechanical Fatigue Life is a measure of the number of cycles until the test specimen fractures in fatigue. Test specimens were subjected to a constant tensile load while being thermally cycled to induce an additional strain equal to $\alpha\Delta T$, where $\alpha$ is the substrate coefficient of thermal expansion, and $\Delta T$ is the temperature range over which the specimen was cycled. The test conditions were chosen to simulate the strain and temperature cycling of a blade in the turbine section of a gas turbine engine.

Referring to FIG. 3, the Plasma Sprayed NiCoCrAlY+Hf+Si overlay is representative of the coating described in U.S. Pat. No. Re. 32,121. The Electron Beam NiCoCrAlY is representative of the coating described in U.S. Pat. No. 3,928,026. The MCrAlY over Aluminide coating is representative of the coating described in U.S. Pat. No. 4,005,989. The coating denoted "Prior Art Aluminized MCrAlY" was a 0.006 inch NiCoCrAlY coating which was aluminized using pack cementation techniques to cause diffusion of Al into the outer 0.002 inches of the overlay.

Aluminide A is representative of a diffusion coating produced by a pack cementation process similar to that described in U.S. Pat. No. 3,544,348. Aluminide B is representative of a diffusion coating produced by a gas phase deposition process similar to that described in U.S. Pat. No. 4,132,816, but with slight modifications to enhance the thermal fatigue resistance of the coated component. The coating denoted "Invention Aluminized MCrAlY" had a microstructure similar to that shown in FIG. 2, an was produced by aluminizing a thin MCrAlY overlay according to the process described below.

As is apparent from FIG. 3, the coating of the present invention exhibits resistance to oxidation degradation which is comparable to the most oxidation resistant coating which was tested. Also, the coating of the present invention exhibits resistance to thermal mechanical fatigue which is comparable to the most crack resistant coating which as tested. Thus, a unique and never before achieved combination of properties is achieved by this yttrium enriched aluminide coating.

The coating of the present invention can be produced using techniques known in the art. One method is by aluminizing an MCrAlY coated superalloy using pack cementation techniques. As noted above, in the prior-art aluminized MCrAlY coatings, the MCrAlY is generally 0.003–0.005 inches thick. Also in the prior art, the aluminizing step is usually carried out to limit the Al content to less than 20 weight percent according to U.S. Pat. No. 3,961,098, although U.S. Pat. No. Re. 30,995 specifies less than 10 weight percent. In the present invention, the MCrAlY overlay is relatively thin: less than about 0.003 inches thick and preferably between about 0.0005 and 0.0015 inches thick. The aluminizing process is carried out so that the resultant Al content in the outer coating zone (FIG. 2) is at least 20%. It is believed that the desirable oxidation resistance of the coating of the present invention is due to the presence of yttrium in the outer coating zone which contains such a high aluminum content. The high Al content provides good resistance to oxidation degradation, and the presence of Y results in improved alumina scale adherence, and a resultant reduced rate of Al depletion from the coating. That the coating of the present invention has improved fatigue properties (FIG. 3) when the Al content is greater than 20% is surprising, and contrary to the teachings of the prior art. See, for example, U.S. Pat. No. 3,961,098. The favorable resistance to thermal mechanical fatigue cracking is believed due to the thinness of the coating and the interaction of the inner and outer coating zones. The combined thickness of the outer and inner zones should be about 0.001 to 0.004 inches, preferably about 0.002 to 0.003 inches. If a crack forms in the outer zone, the propagation rate of the crack will be relatively low due to the thinness of the outer zone, in accordance with crack propagation theories of Griffith, discussed in e.g., F. A. Clintock and A. S. Argon, Mechanical Behavior of Materials, Addison-Wesley, 1966, pp. 194–195. Once the crack reaches the diffusion zone, the crack surfaces will begin to oxidize, because the diffusion zone contains a lesser concentration of Al than the outer zone. As the crack oxidizes, the surfaces of the crack will become rough, and the crack tip will become blunted thereby reducing its propagation rate.

As noted above, the diffusion zone contains elements of the substrate. Superalloys generally contain refractory elements such as W, Ta, Mo, and Cb for solid solution strengthening, as disucssed in U.S. Pat. No. 4,402,772. During the elevated temperature aluminizing process, these elements tend to migrate into the diffusion zone. Some refractory elements are known to decrease oxidation resistance, and due to their presence in the diffusion zone, the diffusion zone has poorer resistance to oxidation than the outer zone and the substrate. Thus, once the crack reaches the diffusion zone, oxidation of the crack surfaces proceeds at a rate which is more rapid than the rate in either the outer zone or the substrate, thereby significantly decreasing the crack propagation rate.

The MCrAlY coating can be applied by, e.g., plasma spraying, electron beam evaporation, electroplating, sputtering, or slurry deposition. Preferably, the MCrAlY coating is applied by plasma spraying powder having the following composition, on a weight percent basis: 10–40 Co, 5–30 Cr, 5–15 Al, 1–5 Y, with the balance essentially Ni. A more preferred composition range is 20–38 Co, 12–20 Cr, 10–14 Al, 2–3.5 Y, balance Ni. The most preferred composition is about 35 Co, 15 Cr, 11 Al, 2.5 Y, balance Ni. The plasma spray operation is carried out under conditions whereby the powder particles are substantially molten when they strike the substrate surface.

After the MCrAlY coating has been applied to the surface of the superalloy component, aluminum is diffused completely through the MCrAlY coating and to a significant depth into the superalloy substrate. Preferably, the MCrAlY coated component is aluminized using pack cementation techniques. During the aluminizing process, aluminum reacts with the MCrAlY overlay coating to transform it into an yttrium enriched aluminide coating. While pack cementation according to e.g., U.S. Pat. No. 3,544,348 is the preferred method for diffusing Al into, and through, the MCrAlY overlay, Al may be diffused by gas phase deposition, or by, e.g., applying a layer of aluminum (o an alloy thereof) onto the surface of the MCrAlY, and then subjecting the coated component to a heat treatment which will diffuse the aluminum layer through the MCrAlY and into the superalloy substrate.

The layer of aluminum can be deposited by techniques such as electroplating, sputtering, flame spraying, or by a slurry technique.

The present invention may be better understood through reference to the following example which is meant to be illustrative rather than limiting.

EXAMPLE I

NiCoCrAlY powder having a nominal particle size range of 5–44 microns and a nominal composition of, on a weight percent basis, 20 Co, 15 Cr, 11.5 Al, 2.5 Y, balance Ni, was plasma sprayed onto the surface of a single crystal Ni-base superalloy having a nominal composition of 10 Cr, 5 Co, 4 W, 1.5 Ti, 12 Ta, 5 Al, balance Ni. The NiCoCrAlY powder was sprayed using a low pressure chamber spray apparatus (Mode 005) sold by the Electro Plasma Corporation. The spray apparatus included a sealed chamber in which the specimens were sprayed; the chamber was maintained with an argon atmosphere at a reduced pressure of about 50 millimeters Hg. The plasma spraying was conducted at 50 volts and 1,520 amperes with 85% Ar-15% He arc gas. At these conditions, the powder particles were substantially molten when they impacted the superalloy surface. A powder feed rate of 0.3 pounds per minute was used, and the resultant MCrAlY produced was about 0.001 inches thick and was similar to the coating shown in FIG. 1.

After the NiCoCrAlY coating was applied to the superalloy surface, it was glass bead peened at an intensity of 0.017–0.019 inches N, and then the component was aluminized in a pack cementation mixture which contained, on a weight percent basis, 10 $Co_2Al_5$, 1 Cr, 0.5 $NH_4Cl$, balance $Al_2O_3$. The aluminizing process was carried out at 1,875° F. for 3 hours, in an argon atmosphere. The coated component was then given a diffusion heat treatment at 1,975° F. for 4 hours and a precipitation heat treatment at 1,600° F. for 32 hours.

Metallographic examination of the aluminized NiCoCrAlY coated Ni-base superalloy revealed a duplex microstructure, similar to that shown in FIG. 2; the outer zone was about 0.002 inches thick, and the diffusion zone was about 0.001 inches thick. Thus, the combined coating thickness (outer zone plus diffusion zone) was about 0.003 inches thick, and was about 200% greater than the initial MCrAlY coating thickness. Additionally, the diffusion zone extended inward of the outer zone an amount equal to about 50% of the outer zone thickness. Preferably, the diffusion zone thickness is at least about 30% of the thickness of the outer zone. The nominal composition of the outer zone was determined by electron microprobe microanalysis, which revealed that, on a weight percent basis, the Al concentration was about 24–31, the Y concentration was about 0.3–0.7, the Cr concentration was about 5–18, the Co concentration was less than about 30, with the balance essentially Ni. The diffusion zone contained a lesser Al concentration than the outer zone, and a greater Al concentration than the substrate. In general, the Al concentration in the diffusion zone decreased as a function of depth, although the desirable properties of the coating of the present invention is not dependent on such a depth dependent Al gradient in the diffusion zone. The diffusion zone also contained compounds of the substrate elements.

In oxidation testing conducted at 2,100° F., the above described coating protected the substrate from degradation for about 1,250 hours, which was comparable to the protection provided by a plasma sprayed NiCoCrAlY+Hf+Si overlay. In thermal mechanical fatigue testing, wherein specimens were subjected to a strain rate of 0.5% while being alternately heated to a temperature of 800° and 1,900° F., coated nickel base single crystal superalloy test specimens had a life to failure of about 15,000 cycles, which was comparable to the life of a thin aluminide coated specimen (Aluminide B of FIG. 2).

EXAMPLE II

Tests were conducted to determine whether there was a critical range of MCrAlY compositions which exhibited superior oxidation resistance when aluminized. In these tests, the MCrAlY coatings were applied by low pressure plasma spray techniques, and then peened, aluminized, and heat treated in the manner set forth in Example I. The as-applied MCrAlY coating thickness was about 0.001 inches. The MCrAlY compositions evaluated in this example were as follows:

| | Composition (weight percent) | | | | |
|---|---|---|---|---|---|
| Sample | Ni | Co | Cr | Al | Y |
| A | 47 | 23 | 18 | 12 | 0.0 |
| B | 80 | 0 | 5 | 6 | 9.1 |
| C | 0 | 70 | 15 | 12.5 | 2.5 |
| D | 44 | 23 | 18 | 13 | 1.7 |
| E* | 55 | 10 | 18 | 13 | 3.5 |
| F | 43 | 23 | 19 | 13 | 2.5 |
| G | 35 | 35 | 15 | 13 | 3.1 |
| H | 37 | 35 | 15 | 11 | 2.1 |

*Also contained 0.7% Hf

Figure 4:
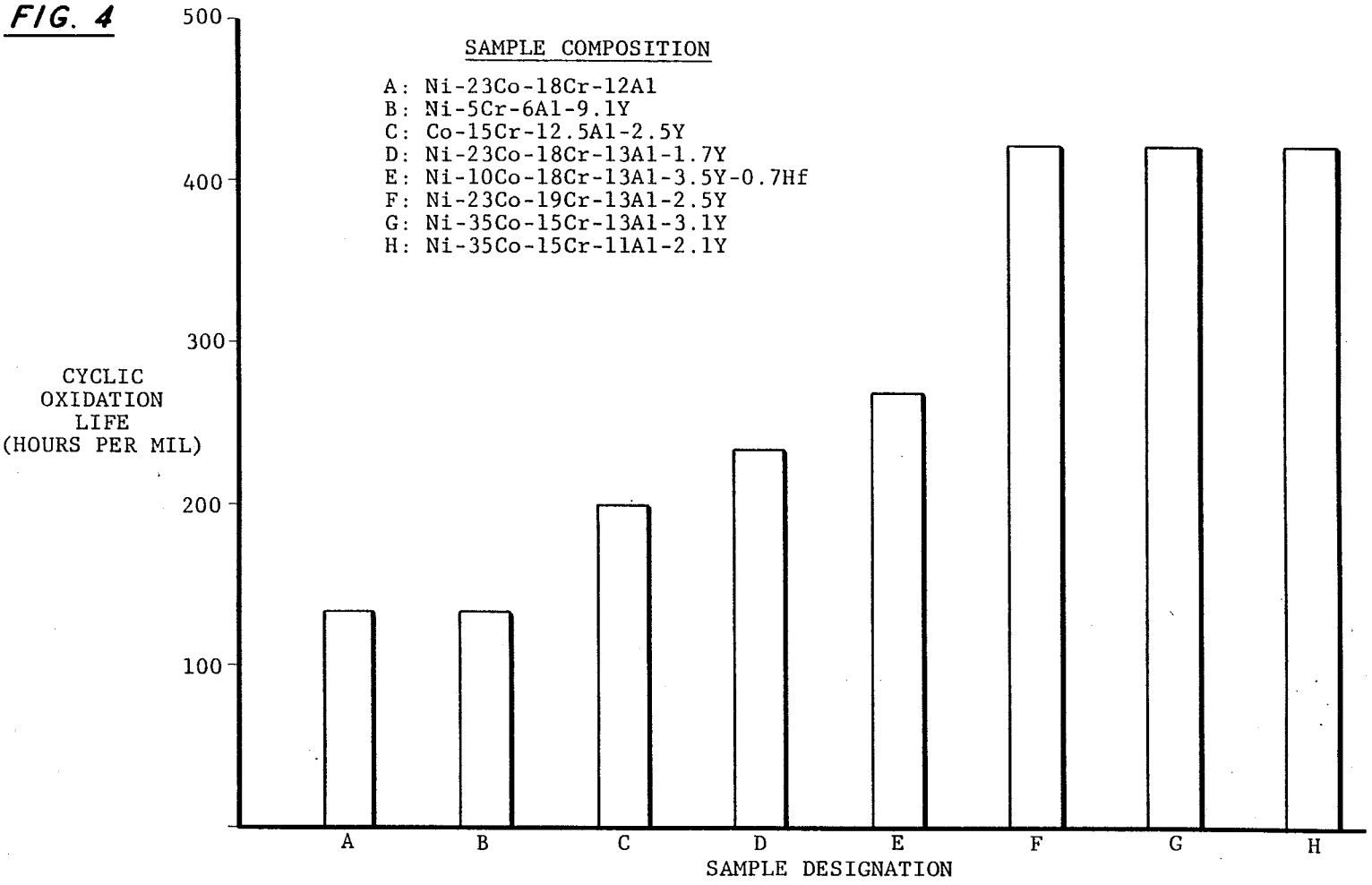
FIG. 4 shows the results of cyclic oxidation tests of several coatings, including the coating of this invention.

Results of burner rig oxidation testing, where the specimens were heated to about 2,100° F. and held for 55 minutes, and then force air cooled for about 5 minutes, are shown in FIG. 4. This Figure shows that maximum oxidation resistance was achieved with compositions having a yttrium level between about 2 and 3.5 percent, and a cobalt level between about 20 and 38 percent. Chromium was between about 12–20 percent, aluminum between about 10–14 percent, and the balance was nickel. The need for particular yttrium and cobalt levels are seen on review of the data for samples F, G, and H, which had the best cyclic oxidation life of any of the samples which were tested. The oxidation resistance of the other specimens, which had yttrium and cobalt levels outside of the aforementioned range, were notably inferior, which may be at least partially explained in the following manner: the complete absence of yttrium in sample A resulted in a coating which had poor oxide scale adherence. Yttrium is noted for its beneficial effects on oxide scaled adherence, and the performance of sample A was not unexpected. The very high yttrium level in sample B resulted in a coating having an undesirably low melting point. It also resulted in a coating containing particles enriched in yttrium, which act as sites for internal oxidation (yttrium is readily oxidized). Overlay coatings characterized by the presence of such particles have poor overall oxidation resistance. Sample B also contained no cobalt and too little chromium and aluminum. Sample C shows the effect of no nickel and very high cobalt in the MCrAlY coating, even though yttrium is in the target range. Sample D shows the effect of a low yttrium content even though cobalt is in the target range. And sample E shows the effect of low cobalt even though yttrium is in the target range.

EXAMPLE III

Cyclic oxidation tests were conducted at 2,100° F. to compare the coating life the number of hours required to oxidize one mil of coating) of an overlay coating having the NiCoCrAlY composition preferred in the practice of this invention with the invention yttrium enriched aluminide coating made with the same NiCoCrAlY composition. The nominal composition of the NiCoCrAlY was Ni-35Co-15Cr-11Y-2.5Y, and the overlay coating was sprayed, peened and then heat treated in the manner set forth in Example I. The yttrium enriched aluminide coating was also made in the manner set forth in Example I.

These tests indicated that the coating life of the overlay coating was about 170 hours per mil, while the life of the invention coating was about 410 hours per mil. The invention process improved the coating life nearly 150%.

It should be reiterated that, as described in the Background Art section, MCrAlY overlays useful in producing a coating according to the present invention may contain additions or substitutions of noble metals, hafnium, silicon, or other rare earths such as ytterbium. Also, the MCrAlY may be applied by techniques other than plasma spraying; aluminum may be diffused into the overlay by techniques other than pack cementation, as described above.

Although the invention has been shown and described with respect to a preferred embodiment thereof, it should be understood by those skilled in the art that other various changes and omissions in the form and detail thereof may be made therein without departing from the spirit and scope of the invention.

We claim:

1. A process for applying an oxidation and thermal fatigue resistant coating to a nickel or cobalt base superalloy article, comprising the steps of (a) applying a 0.0005–0.003 inch thick NiCoCrAlY coating to the article surface, the coating consisting essentially of, by weight percent, 20–38 Co, 12–20 Cr, 10–14 Al, 2–3.5 Y, balance Ni; and (b) diffusing Al through the NiCoCrAlY coating and into the article so as to form a coating having an outer zone adjacent the surface and a diffusion zone inward thereof, wherein the outer zone contains about 21–35 weight percent Al, and where the diffusion zone contains less Al than the outer zone and more Al than the article, wherein the combined thickness of the outer zone and diffusion zone is about 0.001–0.004 inches.

2. The process of claim 1, wherein the NiCoCrAlY coating consists essentially of about 30–38 Co, 12–20 Cr, 10–14 Al, 2–3.5 Y, balance Ni.

3. The process of claim 1, wherein the NiCoCrAlY coating consists essentially of about 35 Co, 15 Cr, 11 Al, 2.5 Y, balance Ni.

4. A coated nickel or cobalt base superalloy article, wherein the coating is an 0.001–0.004 inch thick yttrium enriched aluminide coating and is characterized by an outer coating zone and a diffusion zone inward thereof, the outer zone containing about 20–35 weight percent aluminum and about 0.2–2.0 weight percent yttrium, and the diffusion zone containing less aluminum than the outer zone and more aluminum than the superalloy article.

* * * * *